US009169617B2

(12) United States Patent
Behan et al.

(10) Patent No.: US 9,169,617 B2
(45) Date of Patent: Oct. 27, 2015

(54) PLOW FOR USE WITH AUTOMOBILE

(75) Inventors: Richard Anthony Behan, West Chicago, IL (US); Paulette Sanders Behan, West Chicago, IL (US)

(73) Assignee: NORDIC AUTO PLOW, LLC, West Chicago, IL (US)

( * ) Notice: Subject to any disclaimer, the term of this patent is extended or adjusted under 35 U.S.C. 154(b) by 521 days.

(21) Appl. No.: 13/273,445

(22) Filed: Oct. 14, 2011

(65) Prior Publication Data

US 2014/0373397 A1 Dec. 25, 2014

(51) Int. Cl.
*E02F 3/76* (2006.01)
*E02F 3/815* (2006.01)
*E01H 5/06* (2006.01)

(52) U.S. Cl.
CPC ..... *E02F 3/7627* (2013.01); *E01H 5/06* (2013.01); *E02F 3/815* (2013.01)

(58) Field of Classification Search
CPC ..... E02F 3/7627; E02F 3/815; E01H 5/06
USPC ..... 37/231, 267, 285
See application file for complete search history.

(56) References Cited

U.S. PATENT DOCUMENTS 1,142,677 A * 6/1915 Darois ..... 37/218
1,195,271 A * 8/1916 Ruth ..... 37/232
1,805,933 A * 5/1931 Harold ..... 280/160
2,141,558 A * 12/1938 Richter ..... 37/231
2,188,805 A * 1/1940 Borgeson ..... 37/231
2,191,323 A * 2/1940 Richter ..... 37/231
2,347,963 A * 5/1944 O'Neill ..... 15/245
2,430,221 A * 11/1947 Frink et al. ..... 37/231
2,468,950 A * 5/1949 Wiedman ..... 37/231
2,575,091 A * 11/1951 Borgeson ..... 37/231
2,582,136 A * 1/1952 Koblas ..... 37/263
2,622,349 A * 12/1952 Kinnan ..... 172/445.2
2,722,064 A * 11/1955 Jaffe et al. ..... 37/231
2,754,601 A * 7/1956 Meyer ..... 37/231
2,920,187 A * 1/1960 Barilla ..... 362/335
3,098,309 A * 7/1963 Koch ..... 37/231
3,316,665 A * 5/1967 Rinaldo ..... 37/231
3,349,507 A * 10/1967 Payne ..... 37/231
3,448,534 A 6/1969 Pipes et al.
3,608,216 A * 9/1971 Prescott ..... 37/231
3,760,883 A 9/1973 Birk
3,866,342 A * 2/1975 Cooper ..... 37/407
4,073,077 A * 2/1978 Essel et al. ..... 37/281
4,304,056 A 12/1981 Watson et al.
4,574,502 A 3/1986 Blau
4,754,562 A 7/1988 McGarrah et al.
4,833,799 A * 5/1989 Harte et al. ..... 37/231
4,873,775 A * 10/1989 Richey ..... 37/231

(Continued)

*Primary Examiner* — Jamie L McGowan
(74) *Attorney, Agent, or Firm* — Vedder Price, P.C.

(57) ABSTRACT

A personal use plow for pushing, but not limited to, snow and slush from ones driveway by most passenger automobiles and/or ATV's that is attached using a unique strapping and cog bracing system. The plow is made of injected molded structural foam plastic and comes in 5 separate panels that can be easily assembled into a solid plow blade. This material is lightweight and allows for easy transportation, storage, and use. When assembled, the plow can be used either in the front or back of the vehicle. The plow attaches to the vehicle by a special hook, designed as part of this patent, which attaches to the hood, trunk, or luggage rack of the vehicle. All parts for the functionality of the plow are contained on the plow itself, so there are no brackets or hitches required to be attached to the bumpers or vehicle.

14 Claims, 5 Drawing Sheets

(56) References Cited

U.S. PATENT DOCUMENTS

| | | | | | |
|---|---|---|---|---|---|
| 4,944,104 | A | | 7/1990 | Kowalczyk | |
| 4,962,598 | A | | 10/1990 | Woolhiser et al. | |
| 4,976,053 | A | | 12/1990 | Caley | |
| 5,036,608 | A | | 8/1991 | Ciula | |
| 5,111,603 | A | | 5/1992 | Knowlton et al. | |
| 5,125,174 | A | | 6/1992 | Watson et al. | |
| 5,129,170 | A | | 7/1992 | Fusilli | |
| 5,136,795 | A | | 8/1992 | Rosenberg | |
| 5,193,296 | A | | 3/1993 | Reilley | |
| 5,195,261 | A | | 3/1993 | Vachon | |
| 5,207,010 | A | | 5/1993 | Grossman | |
| 5,228,734 | A | * | 7/1993 | Pollastro | 294/54.5 |
| 5,251,390 | A | | 10/1993 | Wong | |
| 5,271,169 | A | | 12/1993 | Konsztowicz | |
| 5,509,219 | A | | 4/1996 | Mecca | |
| 5,511,328 | A | * | 4/1996 | Fingerer et al. | 37/285 |
| 5,531,036 | A | * | 7/1996 | Shinkle | 37/405 |
| 5,676,412 | A | * | 10/1997 | Kahley | 294/53.5 |
| D391,271 | S | | 2/1998 | Matisz et al. | |
| 6,009,642 | A | * | 1/2000 | Nugent | 37/231 |
| 6,240,662 | B1 | * | 6/2001 | Borowiak | 37/404 |
| 6,299,381 | B1 | * | 10/2001 | Liebrecht, Jr. | 405/181 |
| 6,516,544 | B1 | | 2/2003 | Matisz et al. | |
| 6,681,505 | B1 | * | 1/2004 | Wells | 37/281 |
| 6,964,121 | B2 | * | 11/2005 | Harris | 37/231 |
| 6,983,558 | B2 | | 1/2006 | Haas | |
| 7,237,814 | B2 | * | 7/2007 | Handzlik | 294/54.5 |
| 7,509,758 | B2 | * | 3/2009 | Nesseth | 37/231 |
| 7,685,748 | B1 | * | 3/2010 | Anderson | 37/266 |
| 7,730,643 | B2 | * | 6/2010 | Mishra et al. | 37/266 |
| 7,793,440 | B1 | * | 9/2010 | Ropog | 37/266 |
| 8,176,661 | B2 | * | 5/2012 | Brame | 37/266 |
| 8,291,622 | B2 | * | 10/2012 | Gappy | 37/231 |
| 8,381,421 | B2 | * | 2/2013 | Lhota et al. | 37/231 |
| 8,393,096 | B2 | * | 3/2013 | Thomas | 37/241 |
| 2007/0089327 | A1 | * | 4/2007 | Watson | 37/281 |
| 2009/0249657 | A1 | * | 10/2009 | Freeman | 37/231 |

* cited by examiner 36
34
24
26
22
32
28
30
12

36
34
24
26
32
28
30
64

29
41
46
40
38
42
39
48

29
46
41
38
40
39
44
48

45
39
44
40
38

45
47
49

66
60
30
62
64
62

30
66
60
62
62

36

71
70
71
72

20

36

70
72
71
71

20

PLOW FOR USE WITH AUTOMOBILE

FIELD OF THE INVENTION

The present invention relates to a plow for use with an automobile to push snow, sand, gravel and other such materials.

BACKGROUND OF THE INVENTION

This invention relates to a lightweight plow that can be attached to the front of a motor vehicle such as an automobile or small truck or an ATV, for use in removing snow from a residential driveway. It may also be used for occasional moving of other materials such as sand or gravel. There are many commonly used methods of removing snow from residential driveways; snow shovels, snow blowers, and heavy hydraulically operated snow plows mounted on the front of trucks. The deficiencies of the snow shovel are that it requires heavy lifting and/or pushing of snow in back breaking fashion in multiple, small quantities. Snow blowers can be quite expensive, require trips to the gas station for fuel, may have persistent starting problems, and may be inefficient due to wind conditions. Both shoveling and snow blowers require the user to be out in the cold elements and require them to be in relatively good health as to avoid stress on their hearts. The snow plows attached to trucks require enormous investment in both the vehicle and the plow. The plows are usually made of steel which will rust over time, and require substantial storage space. The hydraulics used to operate the plows require substantial maintenance. Finally, the majority of home owners do not have there own truck and snow plow, but must hire someone to clear their drive. This may result in the drive not being cleared as soon as the homeowner would prefer.

While not commonly used, arrangements have been disclosed in the past for attaching a plow to a passenger vehicle. Many such arrangements required welding or bolting plow support structures to the frame or other metal structures, such as metal bumpers, of the automobile. The following patents disclose arrangements for propelling plows by an automobile which do not require the bolting, clamping or welding of metal structures to the automobile:

| U.S. Patent No. | Date of Patent | Inventor |
|---|---|---|
| U.S. Pat. No. 3,448,534 | Jun. 10, 1969 | Pipes et al |
| U.S. Pat. No. 4,944,104 | Jul. 31, 1990 | Kowalczyk |
| U.S. Pat. No. 5,136,795 | Aug. 11, 1992 | Rosenberg |
| U.S. Pat. No. 5,207,010 | May 4, 1993 | Grossman |
| U.S. Pat. No. 6,516,544 | Feb. 11, 2003 | Matisz et al |

The Pipes et al patent sets forth a snowplow for a vehicle which attached to a vehicle by a pair of universal bumper hitch assembly 64 each of which includes a rod 66 extending from the bumper to the rear of the mold bars 16. Thus, the snowplow arrangement of the Pipes et al patent is not usable with current automobiles that do not have bumpers. Similarly, the snow plow assembly of the Rosenberg patent is attached to the bumper of an automobile. The Kowalczyk patent reveals a snow plow blade which is supported on the vertical portions of two L-shaped Members, with the horizontal portions being attached to the automobile by suction cups. The Grossman patent sets forth a snow plow which is formed by folding sheets of planar material, and attaching the formed snow plow to an automobile with straps, Velcro strips, screw, bolts, adhesives, or any other suitable material. The Matisz et al patent shows a snow plow consisting of two blade wing sections, each of which has an integrally formed bumper column which engages the bumper of a vehicle. Each of the two blade wing sections are secured to the vehicle by a strap.

SUMMARY OF THE INVENTION

It is an object of this invention to provide a plow which is readily attached to an automobile without requiring any modification of the automobile and without requiring the use of tools. It is another object of this invention to provide a plow which is light weight, such that it may be readily positioned for use on a vehicle and removed therefrom for storage. It is still another object of this invention to provide a plow having a blade which is provided in segments which may be readily attached to each other. A still further object of this invention is to provide a plow which includes readily assembled parts which make the plow adaptable for use on a variety of vehicles and for aligning the plow to move the plowed material to the right, left or directly ahead of the direction of movement of the vehicle.

DETAILED DESCRIPTION OF THE PREFERRED EMBODIMENT

Figure 1:
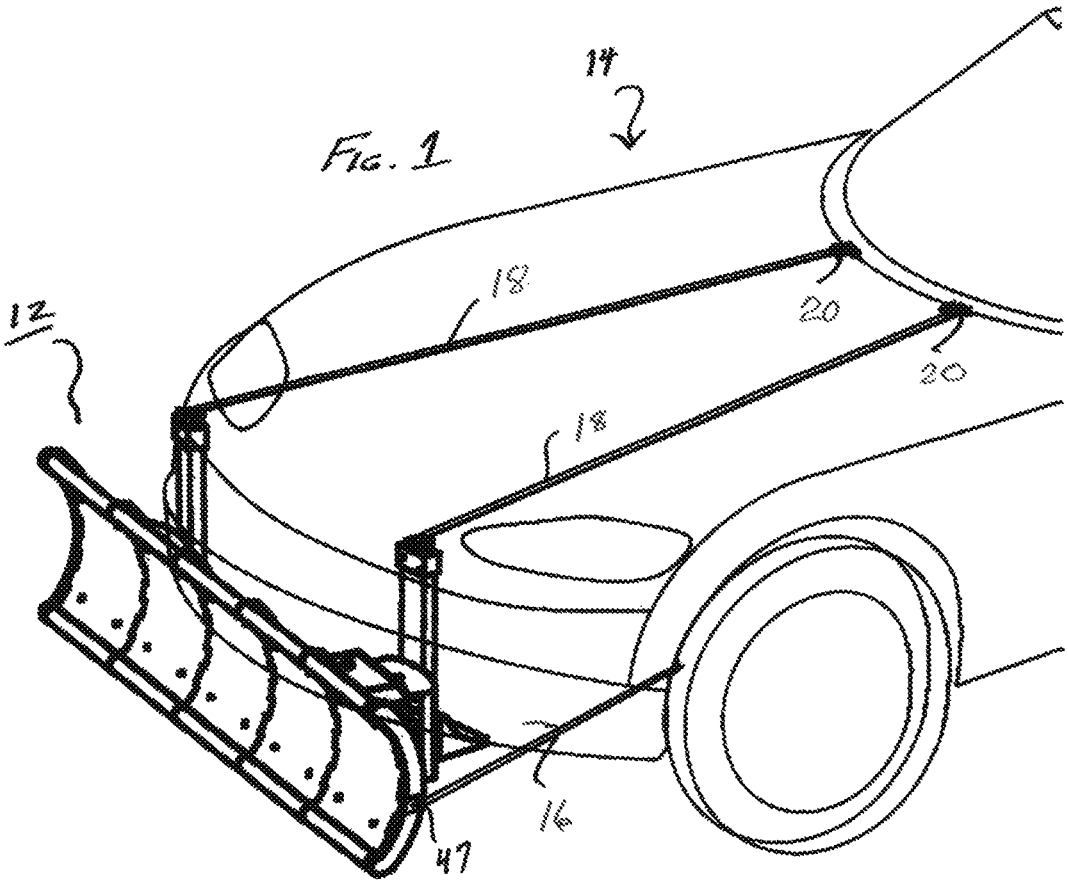
FIG. 1 is a perspective view of a plow in accordance with this invention mounted on the front of an automobile.

Referring to FIG. 1, a plow 12 is accordance with this invention is positioned at the front of an automobile 14, for plowing material in front of the automobile. Portions of the plow engage the lower front trim 16 of the automobile, and straps 18 extend from the plow to clips 20 engaging the rear edge of the automobile hood.

Figure 2:
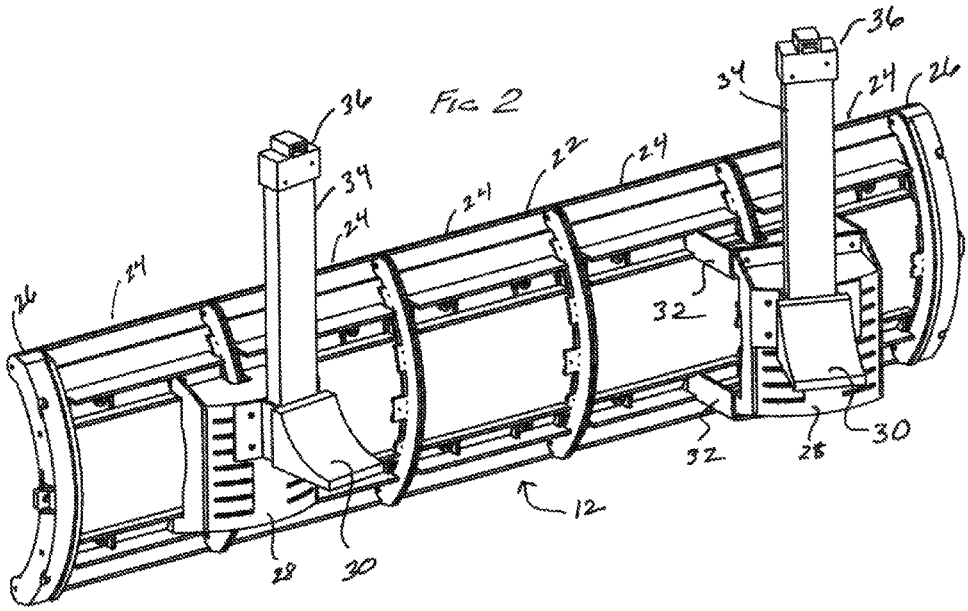
FIG. 2 is a perspective rearview of a plow in accordance with this invention.

Referring to FIG. 2, a plow 12 in accordance with the invention is readily assembled from a plurality of components. The snow plow blade 22 is shown to be an assembled of five identical blade sections 24. However, the snow plow blade may be formed of more or less identical blade sections 24, depending on the width of the automobile or other vehicle, and the width of the area to be plowed. Secured to the back of the blade 22 are two identical cog plates 28, to each of which is secured a cog 30. Such that the blade 22 may be tilted to the right or left with respect to the vehicle to which it is attached, a pair of cog extenders 32 may be placed between the blade 22 and a cog plate 28. Secured in each of the cogs is a stud 34, which extends upward and is provided with a stud cap 36.

Each of the components of the snow plow 12 in accordance with this invention will now be described by making reference to FIGS. 3 and 4-10, *a* and *b*.

Figure 4A:
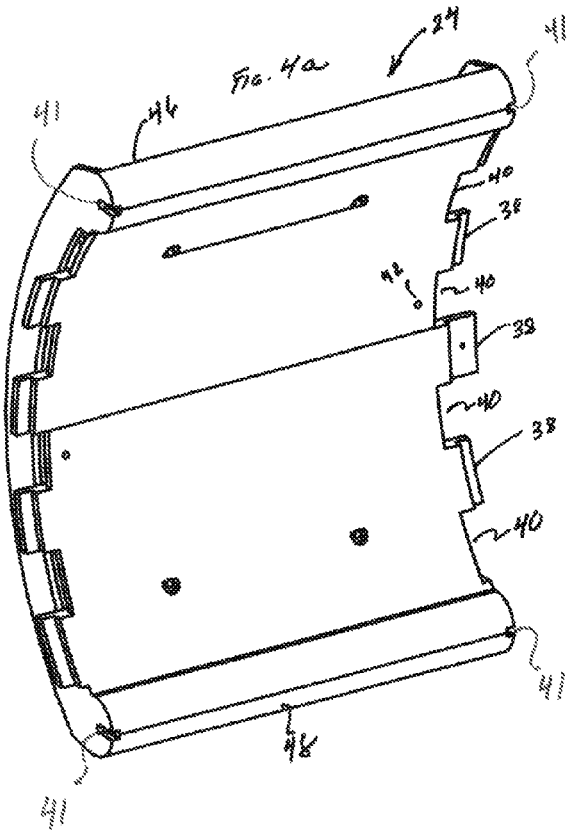
FIGS. 4*a* and 4*b* are respectively front and rear perspective views of a blade section of a plow in accordance with this invention.
Figure 4B:
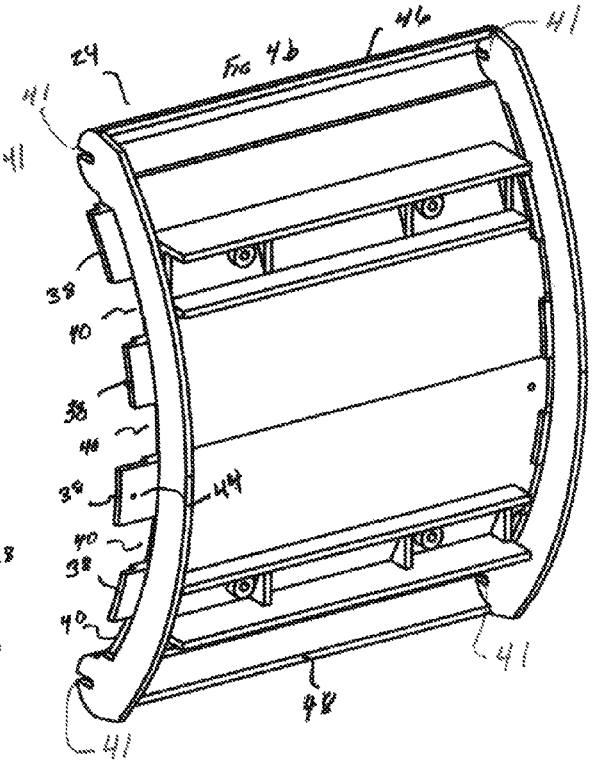

Front and rear views of a blade section 24 are shown in FIGS. 4*a* and 4*b* respectively. Each side of a blade section 24 is provided with alternating tabs 38 and spaces 40. The tabs 38 and the spaces 40 form an interlocking connection between adjacent blade sections. Holes 42 are provided adjacent the spaces 40 and holes 44 in the tabs 38 for receiving screws to secure adjacent blade sections to each other. Holes 41 are provided for receiving fastening bolts to secure adjacent blade section to each other. However, other fastening members could be used.

The blade sections 24 as well as most of the other components of the snow plow 12 are constructed of injected molded structural foam, of sufficient thickness to provide for strength and durability, when plowing, even under the harsh conditions of winter. When bolted together, the combined sections create a strong, yet flexible blade in excess of six feet in length. This flexibility is provided by the material forming the blade sections 24 and by the multiple sections. The flexibility allows for the stress and weight of the snow to be distributed throughout the several blade sections, rather than just in the area directly affected.

The top 46 and the bottom 48 of each of the blade sections 24 is provided with a rounded reinforced edge that enhances the durability of the snow plow as it pushes snow over a concrete, gravel or asphalt surface. The top 46 and bottom 48 of a blade section may be rotated, so as to replace a worn bottom 48 with an unworn top 46. The rounded edges, along with the flexibility of the blade, will keep the blade from getting stuck against cracks or solid ice. In addition, the blade is designed so that the top and bottom are the same, thus making it reversible, and thereby doubling the life of the snow plow.

Figure 5A:
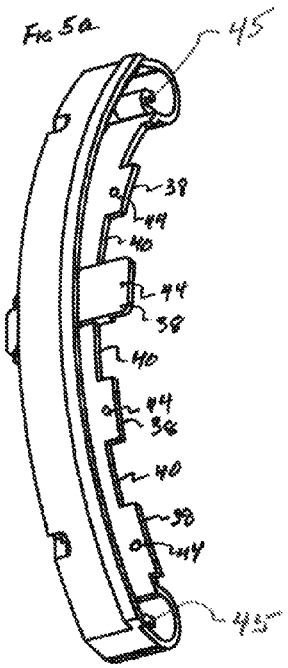
FIGS. 5*a* and 5*b* are respectively outer and inner perspective views of an end cap for the blade sections of a plow in accordance with this invention.
Figure 5B:
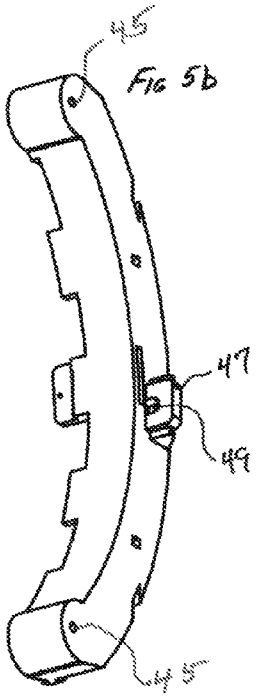

Referring to FIGS. 5*a* and 5*b*, a end cap 26 is shown. An end cap is secured to the outer side of the last blade section 24 on each end of the plow. Again, each of the end caps 26 is secures to the adjacent blade section, being provided with tabs 38 and spaces 40. The tabs 38 and the spaces 40 form an interlocking connection between the end cap 26 and the adjacent blade section 24. Again, holes 42 are provided adjacent the spaces 40 and holes 44 in the tabs 38 for receiving fastening members such as screws to secure adjacent blade sections to each other. Holes 45 are provided for receiving fastening members such as screws to secure an end cap 26 to a blade sections 24 at the outer ends of blade 22. A tab 47 having a hole 49 therein is provided for accommodating the end of a strap, the other end of which strap is secured the automobile to hold the plow against the automobile when the direction of movement of the automobile is reversed from the plowing direction.

Figure 6A:
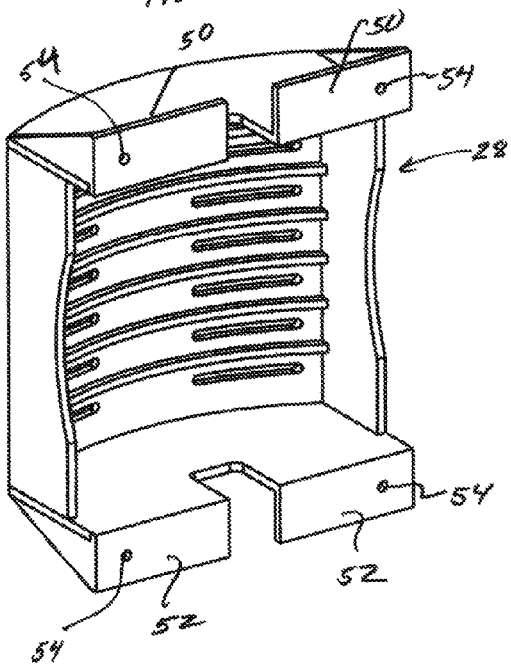
FIGS. 6*a* and 6*b* are respectively front and rear perspective views of a cog plate of a plow in accordance with this invention.
Figure 6B:
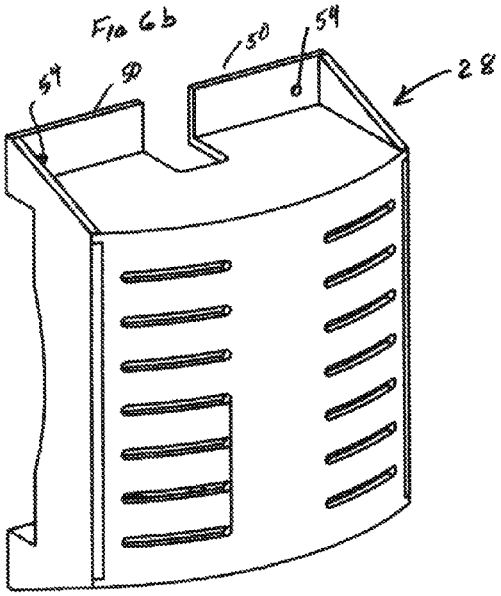

Referring to FIGS. 6*a* and 6*b*, the front and back of a cog plate 28 are shown. Flanges 50 and 52 are provided at the back of the cog plates to be secured to the back of blade sections 24. Holes 54 are provided in the flanges 50 and 52 to receive fastening members such as bolts, or locking pins to secure the cog plates 28 to the back of blade sections 24.

Figure 3:
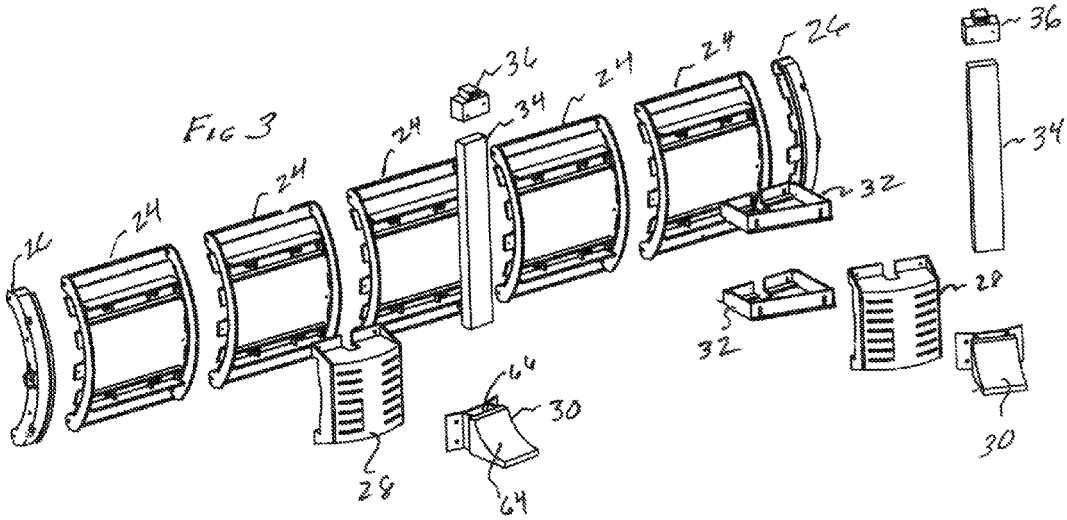
FIG. 3 is an exploded perspective rear view of a plow in accordance with this invention.
Figure 7A:
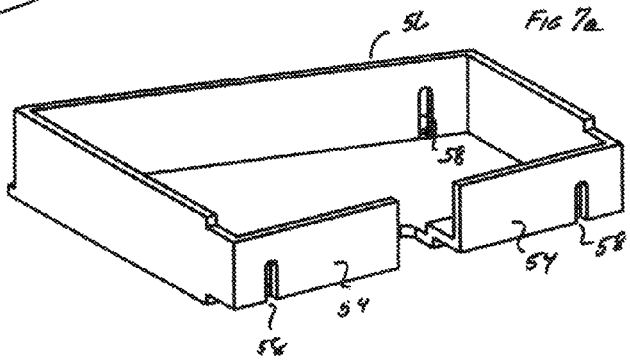
FIGS. 7*a* and 7*b* are respectively top and bottom perspective views of a cog extender of a plow in accordance with this invention.
Figure 7B:
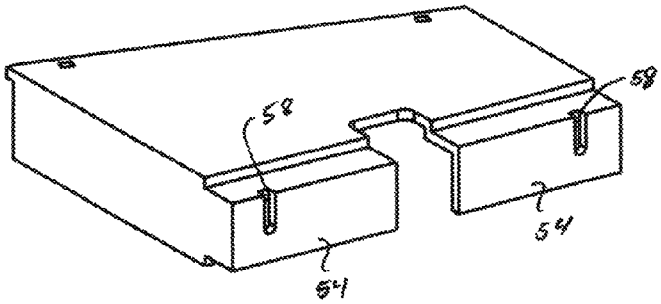
Figure 8A:
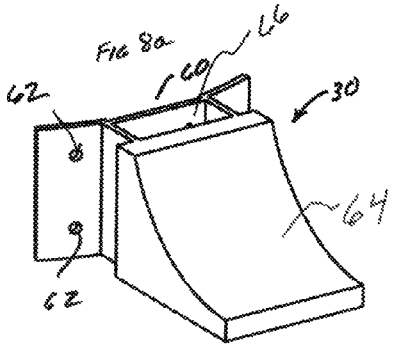
FIGS. 8*a* and 8*b* are respectively rear and bottom perspective views of a cog of a plow in accordance with this invention.
Figure 8B:
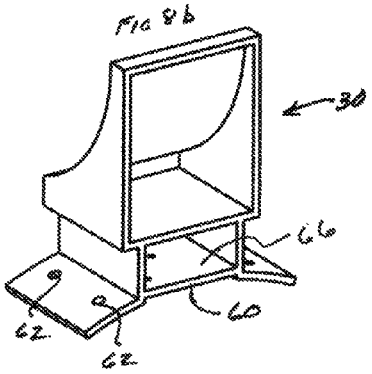

Referring to FIGS. 7*a* and 7*b*, top and bottom views respectively of a cog plate extender 32 are shown. A cog plate extender 32 has a front wall 54 and a back wall 56 which are each provided with slots 58 for receiving fastening members such as bolts, or locking pins to secure the cog plates extender 32 to the back of blade sections 24 and to a cog plate 28. Referring to FIGS. 8*a* and 8*b*, rear and bottom perspective views of a cog 30 which is attached to a cog plate 28 is shown. A cog 30 is provided with a flange 60 having holes 62 therein for receiving a fastening member such as a bolt, or locking pin to secure the cog 30 to a cog plate 28. The cog 30 also has a curved surface 64 which is provided for engagement with the lower trim of an automobile, or a surface of another type of vehicle, to propel the snow plow 12, when the vehicle is moved to cause the plow 12 to move snow or other material. The cog 30 is also provided with a rectangular slot or opening 66, for receiving a stud 34, as shown in FIGS. 1, 2, and 3, which extends upwardly from the plow 12.

Figure 9A:
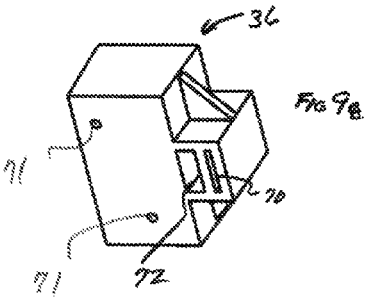
FIGS. 9*a* and 9*b* are respectively rear and bottom perspective views of a stud cap of a plow in accordance with this invention.
Figure 10B:
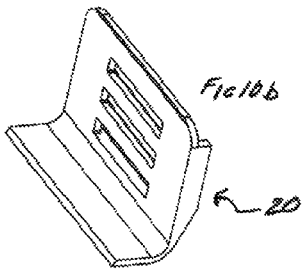
FIGS. 10*a* and 10*b* are respectively top and bottom perspective views of a hood clip of a plow in accordance with this invention.
Figure 9B:
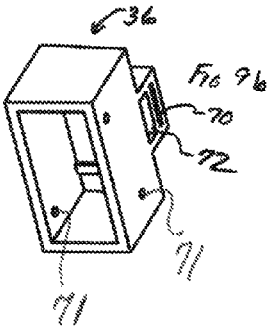
Figure 10A:
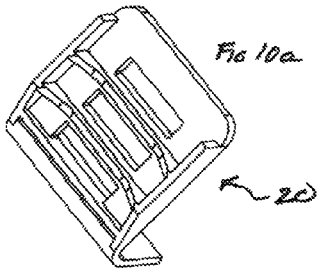

Referring to FIGS. 9*a* and 9*b*, rear and bottom views respectively of a stud cap 36 which is secured to the top of a stud 34 are shown. The top of the stud cap 36 is provided with slots 70 and 72 for securing one end of a strap 18, the other end of which is secured to a strap clip 20 and shown in FIGS. 10*a* and 10*b*. Holes 71 are provided to fasten the studcap 36 to the stud 34 using screws.

The assembly of the plow is simple, such that anyone familiar with the use of a screw driver and wrench can put it together in approximately ten minutes. In the preferred assemble, two bolts attach each of the blade sections and end caps, four bolts attach each cog plate to two adjacent blade sections, or to two cog extenders, and four bolts attach the cog to two adjacent cog plates.

In the preferred embodiment, a stud 34 is formed of typical 2×4 lumber cut to an appropriate length to extend, for instance, above the hood of an automobile with which the plow is to be used. The 2×4 may be wrapped with a material, such as neoprene, to provide a cushion where it comes into engagement with the automobile. The neoprene cover slip may be attached to the stud with hook and loop material. Wood screws may be used to attach a stud 34 to a cog 30 and a stud cap 36. In a preferred assembly, bolts and wing nuts are used to secure a cog to a cog plate. The use of the wing nuts makes it easier to adjust the vertical position of the cog 30 on the cog plate 28, depending on the height of the surface of the vehicle against which the curved surface 64 will bear with respect to the bottom of the blade sections 24. In addition, the cogs 30 can be adjusted to the right or left of center to account for the various curves of the vehicle surface to be engaged by the curved surface 64 of the cog 30. This allows for a flush fit of the stud 34 to the engaging surface of the vehicle, which will keep damage and/or scratches from occurring. In addition to this adjustment, we have included a neoprene cover slip that will attach to the stud with hook and loop material to provide additional protection to the bumper.

The key to the functionality of the blade is the stud and cog assembly. A quick measurement of the height of the bumper or other portion of the engaging vehicle which engages the cog from the ground is made and the cog is tightened into an appropriate slot of the cog plate. The studs 34 are preferably cut to a length that allows for the stud cap to come even with height of the hood or trunk. A typical passenger car requires a 20"-24" length, while an SUV or pickup may be 30"-36" or higher. If the user of the plow of this invention has both types of vehicles, two sets of studs will provide for use of the plow on either vehicle. The cog extender plate can be attached to either the right or left side of the plow depending on which direction from the vehicle you want the plowed material to be displaced. The cog plate extenders 32 can be moved from either side of the blade easily and quickly.

Once the blade is assembled and the location of the cogs 30 and the height of the studs 34 are determined, it will take very little time to complete the attachment to the vehicle for use, regardless if attaching it to the front or back of the vehicle. You begin by leaning the snow plow 12 against the engaging surface of the vehicle. A strap, formed of a material such as nylon, is run through the slots 70 and 72 in the stud cap 36, with the other end slid through the strap clip 20, which engages the top edge of the hood or trunk. The clip 20 is made of, or coated with a material that will not scratch the vehicle, yet is strong enough to keep the strap in place. The strap is pull tight, but not over tightened. When the car is in motion, the weight of the snow and force of the vehicle makes the top of the blade sections and therefor the top of the studs 34 to lean forward away from the vehicle. The strap keeps the stud securely against the bumper thus keeping the snow plow blade upright. In addition, the cog 30 will provide additional support to the stud 34 as it engages a vehicle surface. The combination of the strap 18 and engagement of the cog 30 against the underside of the bumper distributes the stress of the plow while it's pushing snow or other material.

To keep the snow plow 12 attached to the vehicle when going in the opposite direction, a resilient strap or cord, such as a bungee cord is secured to an end cap 26, at hole 49, and the other end to a suitable structure in the wheel well of the vehicle. This allows for the vehicle to go down the driveway pushing snow, return up the driveway, and then change lanes to complete the snow removal. When the task is complete, one may simply unattach the hook clips from the vehicle and store the plow in a suitable location. When the snow plow 12 will not be used for an extended period, such as at the end of winter, it may be easily disassembled and put into a box or bag for easy storage.

While a preferred embodiment of the plow of this invention has been shown, it should be apparent to those skilled in the art that what has been shown and described is considered at present to be a preferred embodiment of the plow of this invention. In accordance with the Patent Statutes, changes may be made in the plow of this invention without actually departing from the true spirit and scope of this invention. The appended claims are intended to cover all such changes and modifications which fall in the true spirit and scope of this invention.

The invention claimed is:

1. A plow for pushing material with a motor vehicle comprising the following components:

two or more blade sections have top and bottom edges which are identical to each other and sides which are provided with spaced tabs with spaces between the tabs along the entire section between the top and bottom edges, the spaced tabs and spaces being positioned such that the spaced tabs on one blade section will mate with spaces on an adjoining blade section, forming an interlocking connection between blade sections, wherein the tabs are part of the blade and form a continuous blade, a pair of blade end caps, said blade end caps provided with spaced tabs with spaces between the tabs, the spaced tabs and spaces being positioned such that the spaced tabs on one blade end cap will mate with spaces on an adjoining blade section, forming an interlocking connection with a blade sections, a pair of cog plates, one of said cog plates being secured to the back of said blade sections, said pair of cog plates being spaced from each other, a pair of cog plate extenders, said pair of cog plate extenders being secured between one of said cog plates and the back of said blade sections, a pair of cogs, each of said cogs being secured to one of said cog plates, each of said cogs having a curved surface for engaging a lower curved surface of the front or back of a motor vehicle, each of said cogs having a slot formed therein, a pair of studs, each of said studs having a lower end received in a slot in one of said cogs, a pair of stud caps, each of said stud caps being placed on the upper end of one of said studs, and each having a strap securing portion, a pair of clips for engaging the edge of the motor vehicle, each of said clips having a strap securing portion, and a pair of straps, each secured at one end to one of said stud caps, and at the other end to one of said pair of clips.

2. The plow for pushing material with a motor vehicle of claim 1, wherein the components of the plow when disassembled may be compactly stored.

3. The plow for pushing material with a motor vehicle of claim 1, wherein the structural components thereof are formed of injected molded composite plastic material.

4. The plow for pushing material with a motor vehicle of claim 1, wherein the top and bottom edges of the blade sections are the same, such that the top and bottom edges of the blade section are reversible.

5. The plow for pushing material with a motor vehicle of claim 4, wherein the reversible top and bottom edges of the plow are rounded to allow for easy gliding over reasonable obstructions in the driveway, such as cracks or solid ice formations.

6. The plow for pushing material with a motor vehicle of claim 1, when said cog plate and said cog plate extenders are secured on each side to adjoining blade sections, such that they extend across the interlocking connection between two blade sections.

7. The plow for pushing material with a motor vehicle of claim 1, wherein a cog may be secured to a cog plate at adjustable vertical and horizontal positions, so as to accommodate use with various motor vehicles.

8. The plow for pushing material with a motor vehicle of claim 1, wherein a connecting tab is provide on each of said blade end caps for securing one end of an extensible member, the other end of which is secured to the motor vehicle, whereby the plow will not move away from the vehicle when the direction of the vehicle is reversed.

9. The plow for pushing material with a motor vehicle of claim 1, wherein the components are secured to each other by fasteners, such as bolts and nuts.

10. A plow for pushing material with a motor vehicle comprising the following components:

two or more blade sections forming a blade with a back, where each of the blade sections includes a top edge and a bottom edge and having sides with spaced tabs along the entire section between the top and bottom edges, the spaced tabs positioned to mate with the spaced tabs of an adjoining blade section forming an interlocking connection between blade sections wherein the tabs are part of the blade and form a continuous blade, at least a cog plate secured to the back of the blade, at least a cog plate extender secured between the cog plate and the back of the blade, at least a cog with at least a slot, the cog secured to the cog plate with a curved surface for engaging a lower curved surface of the motor vehicle, at least two studs, each with a lower end and a strap securing portion, each stud to be received in one of the slots of the one cog, and a first pair of straps, each having one end secured to the strap securing portion of the studs, and at the other end to the end of a portion of the motor vehicle.

11. The plow of claim 10, wherein the top edge and the bottom edges have an identical rounded configuration.

12. The plow of claim 10, wherein the plow further comprises a pair of blade end caps, with spaced tabs to mate to an adjoining blade section.

13. The plow of claim 12, wherein each end cap include a side strap attachment for securing a second pair of straps between the blade end caps and the motor vehicle.

14. The plow of claim 10, wherein the motor vehicle is an automobile.

* * * * *